US009905376B2

(12) United States Patent
Han et al.

(10) Patent No.: US 9,905,376 B2
(45) Date of Patent: Feb. 27, 2018

(54) ARC-ABLATION RESISTANT SWITCH CONTACT AND PREPARATION METHOD THEREOF

(71) Applicant: NANTONG MEMTECH TECHNOLOGIES CO., LTD., Nantong, Jiangsu (CN)

(72) Inventors: Huisheng Han, Jiangsu (CN); Zhenxing Wang, Jiangsu (CN); Yang Ding, Jiangsu (CN); Hongmei Zhang, Jiangsu (CN)

(73) Assignee: Nantong Memtech Technologies Co., Ltd., Nantong, Jiangsu (CN)

( * ) Notice: Subject to any disclaimer, the term of this patent is extended or adjusted under 35 U.S.C. 154(b) by 0 days.

(21) Appl. No.: 15/318,042

(22) PCT Filed: Jul. 15, 2015

(86) PCT No.: PCT/CN2015/084168
§ 371 (c)(1),
(2) Date: Dec. 12, 2016

(87) PCT Pub. No.: WO2016/011912
PCT Pub. Date: Jan. 28, 2016

(65) Prior Publication Data

US 2017/0125179 A1 May 4, 2017

(30) Foreign Application Priority Data

Jul. 21, 2014 (CN) ..... 2014 1 0346964

(51) Int. Cl.
*H01H 1/021* (2006.01)
*H01H 11/04* (2006.01)
(Continued)

(52) U.S. Cl.
CPC ..... *H01H 1/021* (2013.01); *C23C 18/1633* (2013.01); *C23C 18/1692* (2013.01);
(Continued)

(58) Field of Classification Search
CPC ..... H01H 1/021; H01H 1/04; H01H 11/041; H01H 11/06; C23C 18/1633;
(Continued)

(56) References Cited

U.S. PATENT DOCUMENTS 3,862,381 A * 1/1975 Glaister ..... H01H 13/702 200/262
4,929,512 A * 5/1990 Nishimura ..... B32B 15/013 428/610

(Continued)

FOREIGN PATENT DOCUMENTS

CN 103547056 1/2014
CN 203491110 3/2014

(Continued)

OTHER PUBLICATIONS

International Search Report filed in PCT/CN2015/ 084168 dated Aug. 26, 2015.

*Primary Examiner* — Renee S Luebke
*Assistant Examiner* — William Bolton
(74) *Attorney, Agent, or Firm* — Rankin, Hill & Clark LLP

(57) ABSTRACT

An arc-ablation resistant switch contact and a preparation method thereof is disclosed. The switch contact is a complex having a plurality of layers of layered structure, wherein a first layer is a hydrophobic rubber layer, a second layer is an adhesive layer, a third layer is a sheet metal layer, a fourth layer is an adhesive layer, and a fifth layer is a metal plated layer; wherein, the fifth layer of metal plated layer is formed by dipping a complex of the first layer, the second layer, the
(Continued)

third layer and the fourth layer in a chemical plating bath containing refractory metal elements, and depositing on surfaces of the second layer, the third layer and the fourth layer in the complex by a chemical deposition method.

15 Claims, 1 Drawing Sheet

(51) Int. Cl.

| | |
|---|---|
| ***H01H 11/06*** | (2006.01) |
| ***C23C 18/16*** | (2006.01) |
| ***C23C 18/18*** | (2006.01) |
| ***C23C 18/36*** | (2006.01) |
| ***C23C 18/50*** | (2006.01) |
| ***C23C 18/52*** | (2006.01) |
| ***C23C 18/48*** | (2006.01) |
| ***C25D 3/14*** | (2006.01) |
| ***C25D 3/56*** | (2006.01) |
| ***C25D 7/00*** | (2006.01) |

(52) U.S. Cl.
CPC ..... *C23C 18/1806* (2013.01); *C23C 18/1844* (2013.01); *C23C 18/36* (2013.01); *C23C 18/48* (2013.01); *C23C 18/50* (2013.01); *C23C 18/52* (2013.01); *C25D 3/14* (2013.01); *C25D 3/562* (2013.01); *C25D 7/00* (2013.01); *H01H 11/041* (2013.01); *H01H 11/06* (2013.01); *H01H 2011/046* (2013.01)

(58) Field of Classification Search
CPC ..... C23C 18/1692; C23C 18/1806; C23C 18/1844; C23C 18/36; C23C 18/48; C23D 7/00
USPC ..... 218/123, 146, 150; 200/260
See application file for complete search history.

(56) References Cited

U.S. PATENT DOCUMENTS

| | | | | |
|---|---|---|---|---|
| 6,399,219 | B1 * | 6/2002 | Welty | B05D 5/067 428/626 |
| 7,179,546 | B1 * | 2/2007 | Chen | B05D 5/067 428/698 |

FOREIGN PATENT DOCUMENTS

| | | |
|---|---|---|
| CN | 103700517 | 4/2014 |
| CN | 104112609 | 10/2014 |
| JP | 2009256125 | 11/2009 |
| KR | 20080021400 | 3/2008 |

* cited by examiner

ARC-ABLATION RESISTANT SWITCH CONTACT AND PREPARATION METHOD THEREOF

TECHNICAL FIELD

The present invention particularly relates to a spare part between two conductors in a switch or a circuit of an electric or electronic product allowing a current to pass through mutual contact (i.e., an electric contact or contact) and a preparation method thereof.

BACKGROUND

An electrical contact or contact is an important spare part between two conductors in a switch or a circuit allowing a current to pass through mutual contact, which bears the functions of connecting, carrying and disconnecting a normal current and a fault current. The quality and service life of the contact directly determines the quality and service life of the entire switch or circuit. The electrical contact or contact is mainly used in a relay, a contactor, an air switch, a current limiting switch, a motor protector, a microswitch, an instrument, a computer keyboard, a hand-held set, a household appliance, an automotive electrical appliance (a window switch, a rear-view mirror switch, a lamp switch, a starter motor and other load switch), a leakage protection switch, or the like. The electric contact or contact may be prepared of multiple materials, which mainly include silver, silver-nickel, silver-copper oxide, silver-cadmium oxide, silver-tin oxide, silver-tin oxide-indium oxide, silver-zinc oxide, red copper, brass, phosphor copper, bronze, tin-copper, beryllium copper, copper-nickel, zinc-cupro-nickel, stainless steel, or the like.

In automotive appliances, household appliances, computer keyboards, hand-held sets and other devices, switch components thereof are usually printed circuit boards (PCB) provided with contacts and provided with combinations of contacts and rubber keypads. A circular contact on the PCB is divided into two non-conducting halves by a straight line or curve (like an S-shaped curve). The contact on the keypad is a circle without splitting. A circuit on the PCB can be switched on by using a circular contact of the same diameter on the keypad to make a face-to-face contact with the circular contact on the PCB. The contact on the keypad is made of conductive rubber or metal. The conductive rubber has a larger contact resistance when being contacted with the contact of the PCB. The conductive rubber contact is not suitable for switching on a PCB circuit having a large current (such as current greater than 50 mA). The metal contact has a smaller contact resistance when being contacted with the contact of the PCB. The metal contact not only can be used to switch on a PCB circuit having a smaller current, but also can be used to switch on a PCB circuit having a larger current. However, the metal contact has the problems of unsatisfactory chemical corrosion resistance, unsatisfactory arc-erosion resistance and high production cost at present, thus limiting the applications thereof.

In the atmosphere, a switching element usually generates an electric spark or electric arc when switching on or switching off a circuit. The subsistence of the electric arc phenomenon of the switch will result in contact oxidation and ablation, and may carbonize organic matters in the air, thus producing carbon deposition, which gradually increases a contact resistance of the switch and even causes a circuit break of the switch.

A melting point of tungsten in all pure metals is the maximum. The melting point of pure metals above 1850° C. are: tungsten (a melting point of 3410° C.), rhenium (a melting point of 3180° C.), osmium (a melting point of 3045° C.), tantalum (a melting point of 2996° C.) Ha), molybdenum (a melting point of 2610° C.), niobium (a melting point of 2468° C.), hafnium (a melting point of 2227° C.), vanadium (a melting point of 1900° C.), chromium (a melting point of 1875° C.) and zirconium (a melting point of 1852° C.). The refractory metal has a very low vapor pressure and a relatively low evaporation rate at a high temperature vacuum. The relatively low vapor pressure and evaporation rate of the refractory metal are one reason for us to select the alloy of the refractory metal as a contact material.

Preparation methods for refractory metal alloy include a powder metallurgic method, a vacuum arc melting method and a vacuum electron bombardment melting method and so on, wherein the powder metallurgic method is the most widely used. This is because the method is simple in technology and can obtain fine grain alloy ingot, so as to facilitate further plastic processing. The main process of the powder metallurgic method is as follows: the refractory metal powder (such as tungsten powder and molybdenum powder) is mechanically mixed in proportion; a blank is prepared by a mechanical press or an isostatic press; and then an alloy billet is sintered in a high-temperature sintering furnace introducing hydrogen. A sintering temperature is increased with the increase of tungsten content, within a range of 2150° C. to 2300° C. Finally, a sintered billet is rolled or forged. The use of these methods for the preparation of alloys of refractory metals requires relatively expensive equipment, and the shape of the refractory metal alloy prepared is also shaped. By using the most widely used powder metallurgic method, it is difficult to obtain a refractory alloy sheet (especially a tungsten alloy sheet) having a small thickness. If the thicker sheet of refractory metal alloy is used directly in the production of metal contacts, not only the cost of the raw materials of the metal contacts will be increased, but also it is difficult to cut or punch due to the high hardness of refractory metal alloy.

A patent document with a patent application number of 201220499100.X discloses a "Three-layer Composite Electric Contact", wherein the contact is provided with a layer of silver plated on a contact surface of a copper-based contact body, so that the contact has better electrical conductivity, and the production cost is saved than that of completing using silver to produce the contact. Although the electrical conductivity and heat conductivity of the silver are highest among all the metals, the silver has poorer atmosphere corrosion resistance and poorer salt-mist resistance. The silver is easily reacted with sulphuretted hydrogen ($H_2S$) in the atmosphere to generate black silver sulfide. When the silver is used as a contact, although the primary surface resistance is smaller, the service life of the silver in the atmosphere is also limited. Although the cost of silver plating is relatively low, the silver is still one of precious metals. Moreover, in such an electric contact, no rubber layer is provided; therefore, this electric contact is not suitable for performing heat vulcanization adhesion and heat vulcanization shaping with rubber to prepare a rubber keypad containing electric contact. Only a contact containing a rubber layer or a contact entirely made of conductive rubber can possibly perform heat vulcanization adhesion and heat vulcanization shaping with other rubber smoothly so as to prepare the rubber keypad containing contact, without causing quality problems like excessive glue and poor adhesion during heat vulcanization adhesion and heat vulcanization shaping.

A patent document with a patent application number of 200580045811.2 discloses a "Flat Primary Battery with Gold-plated Terminal Contact", which may be applied to, for example, a digital camera. The battery may have a contact containing a lithium anode and a low resistance. The anode and a cathode may present a spirally-crimped sheet form with a baffle therebetween. External anode and cathode contacts are plated by gold so as to improve the contact resistance. Although the electric contact according to the present invention has small resistance, the performance thereof for resisting sparks produced by voltage is not ideal since a melting temperature of gold is poorer than that of tungsten, molybdenum and other refractory metals. Moreover, the expensive price of gold also limits the application range of the electric contact.

A patent document with a patent application number of 201020143455.6 discloses a "Nickel-plated Tungsten Contact", which belongs to the technical field of basic appliance elements, and aims at solving the problem that the existing tungsten contact is easy to be oxidized to affect the electrical conductivity. In the prior art, the existing tungsten contact is mainly prepared by using pure copper as a solder to perform fusion welding on a rivet type seated nail and a tungsten plate. In this patent, an outer surface of the tungsten contact welding on the seated nail and the tungsten plate is enclosed and connected with a nickel-plate layer as the nickel-plated tungsten contact. The nickel-plated tungsten contact has a simple and practical structure and stable electrical conductivity, is durable in use, and is applicable to cars, motorcycles, electric horn and other electrical appliances. The contact of the patent uses the tungsten plate plus the nickel-plated layer, while the arc ablation resistance of nickel is low, so that the contact is not suitable for a relatively harsh occasion needing a higher working current or voltage. Our test shows that the nickel is served as a switch contact connects or disconnects (switches on or off) with the gold-plated contact. At a room temperature, but when the working current is 300 mA, the switching time is about 4000, then the contact resistance of the switch is significantly increased, or even to completely disconnect the circuit.

U.S. Pat. No. 7,169,215 discloses materials and methods for electroless deposition of copper-molybdenum alloy. An electrical resistivity of the obtained copper-molybdenum alloy containing alkali metal ions and alkaline earth metal ions is lower than 30 microohm per centimeter. The alloy is deposited on a thin copper and cobalt film on a single silicon wafer, a thermal oxide silicon layer, and a silicon substrate. The copper-molybdenum alloy may be used as an interconnecting material on a blocked layer between metal layers and a chip. In these applications, copper-molybdenum alloy may replace copper, but a resistivity of the alloy is higher than that of copper. The present invention discloses the activation of a substrate with a palladium solution, and then copper-molybdenum is subject to chemical deposition on various substrates. The invention does not relate to selective chemical deposition. Due to the worse arc-ablation performance, copper-molybdenum alloy is not an ideal arc-ablation contact material.

U.S. Pat. No. 4,019,910 discloses to prepare an electroless nickel alloy plating bath. The nickel alloys contains boron or phosphorus, and one or more metals selected from tin, tungsten, molybdenum or copper. The chemical plating bath contains an ester complex obtained by reacting inorganic acid with polyhydric acid or alcohol, such as diboron ester, tungstate ester or molybdate ester of glucoheptonic acid. The nickel alloy is mainly constituted by nickel, and the nickel content is generally within the range of about 60% to about 95% by weight. The alloy has excellent mechanical property and corrosion resistance, and some alloys such as phosphorus-containing nickel alloys, in particular nickel-phosphorus-tin-copper alloys, have non-magnetic or non-ferromagnetic property. The polymetallic nickel alloy disclosed by the invention contains a relatively high content of boron or phosphorus. In the case of using as a contact material, the relatively large amount of boron or phosphorus will affect the initial resistance of the contact. Our tests show that, pure nickel, nickel alloy with high content of nickel (such as nickel-copper alloy or monel alloy, nickel-chromium alloy, etc.), nickel-containing stainless steel, or nickel alloy using nickel as the main component by chemical plating, if serving as the contact of the switch, have poor arc resistance and low service life of switch.

US patent application 20090088511 discloses a chemical plating bath used for selectively forming a cobalt-based alloy protective film on an exposed copper wire. The chemical plating bath includes a cobalt ion and another metal ion (tungsten and/or molybdenum), a chelating agent, a reducing agent, a specific surface active agent and a tetramethylammonium hydroxide. The use of the bath disclosed in this invention does not require the use of a copper seed layer (e.g., a palladium layer) prior to chemical plating. The protective film has the ability of anti-diffusion and anti-electromigration. However, such protective film has high cobalt content, and thus is harder and brittle. Due to the arc, the cobalt-based alloy is very easy to produce cobaltous oxide and thus leads to increased surface resistance. The arc ablation resistance of this protective film is not good, so that this protective film is not suitable for manufacturing electrical contacts or contacts.

The invention with U.S. Pat. No. 6,797,312 describes a plating bath containing no alkali metal is used for forming a cobalt-tungsten alloy. The plating bath can be formulated without the use of tetramethylammonium hydroxide. Prior to depositing cobalt-tungsten metal alloy onto the substrate a catalyst such as palladium catalyst is not used for pretreating the substrate, and the plating bath can be used for obtaining the deposited cobalt-tungsten alloy layer. The cobalt-tungsten alloy contains a lot of cobalt element, not resisting switch arc ablation. The alloy of this invention also does not relate to how to carry out selective chemical deposition.

The invention with an application patent number 201110193369.5 of the inventor provides a "Pitted-surface metal and rubber composite conductive particle" which is formed by adhering a metal surface layer to a rubber matrix or slitting after adhesion. The metal surface layer is a pitted surface and has concave pits or convex points or both the two; the concave pits or convex points are formed on an outer surface, or an inner surface of the metal surface layer, or both the outer surface and the inner surface; the depths of the concave pits are smaller than the thickness of the metal surface layer; and the heights of the convex points are no less than one tenth of the thickness of the metal surface layer. The metal surface layer is made of metal or alloy, the outer surface can be plated with gold, silver, copper or nickel; the rubber base is silicone rubber or polyurethane rubber; a adhesive layer may be between the metal surface layer and the rubber base, and the adhesive layer is a heat curing adhesion agent, a primer or a material the same as the rubber base. Aids such as a coupling agent can be coated on the inner surface of the metal surface layer. The metal surface layer of the invention has high strength and stable conductivity of electricity, the adhesive layer has high strength, and the rubber matrix has sufficient elasticity. The invention does not provide a solution to the problems of arc ablation resistance of the conductive particles. The present invention also does not propose a specific method of obtaining one or more plated layers on the outer surface of the metal surface layer. In the present invention, the pitted skin is plated with precious metals such as gold and silver. Since the surface area is large, the amount of the precious metal is large and the cost is high.

SUMMARY

The object of the first invention is to provide an arc-ablation resistant tungsten alloy switch contact having low manufacturing cost and large on-current by overcoming the defects of higher cost and low arc resistance of conventional gold-plated, silver-based or silver-plated switch contacts, or by overcoming the defects of worse arc resistance of copper-based, nickel-based or stainless steel contacts having lower cost.

First technical solution: the present invention provides an arc-ablation resistant switch contact, wherein the switch contact is a complex having a plurality of layers of layered structure, wherein a first layer is a hydrophobic rubber layer having a thickness of 0.1-10 mm, a second layer is an adhesive layer having a thickness of 0-1.0 μm, the adhesive layer is formed by a coupling agent or a metal rubber adhesion agent, a third layer is a sheet metal layer having a thickness of 0.01-1.0 mm, a fourth layer is an adhesive layer having a thickness within a range of a thickness of a monomolecular layer to an average thickness of 0.2 μm, the adhesive layer is formed by a coupling agent or a metal rubber adhesion agent, a monomolecular layer is formed on a surface of the sheet metal by the coupling agent, an adhesive layer having a thickness of an average thickness to 0.2 μm on a surface of the sheet metal by the metal rubber adhesion agent; and a fifth layer is a refractory metal plated layer having a thickness of $2*10^{-5}$-0.02 mm; wherein, the fifth layer of refractory metal alloy plated layer is formed by dipping a complex of the first layer, the second layer, the third layer and the fourth layer into a chemical plating bath containing refractory metal elements, and depositing the refractory metal alloy on surfaces of the second layer, the third layer and the fourth layer in the complex of the first layer, the second layer, the third layer and the fourth layer by a chemical deposition method, or is formed by dipping the complex of the first layer, the second layer, the third layer and the fourth layer in a chemical plating bath containing refractory metal elements, and depositing the refractory metal alloy on a surface of the fourth layer in the complex of the first layer, the second layer, the third layer and the fourth layer by a chemical deposition method.

The first layer, the second layer, the third layer and the fourth layer are auxiliary layers of the switch contact. The fifth layer is a working layer of the switch contact, which bears the functions of connecting, carrying and disconnecting a current. The fifth layer may be either deposited on surfaces of the second layer, the third layer and the fourth layer in the complex of the first layer, the second layer, the third layer and the fourth layer, or only deposited on a surface of the fourth layer in the complex.

Obviously, in the prepared contact in a plurality of layers of layered structure, if the fifth layer and the third layer are in electric conduction, and a resistance between the fifth layer and the third layer is sufficiently small, for example less than 10 ohm. In this way, the third layer as the metal layer is possible to carry part of electric conduction function, which will be conducive to the conductive properties of contacts. The lower a resistance between the two layers is, the better. Therefore, the fourth layer between the fifth layer and the third layer shall be thin enough. The average thickness of the fourth layer shall be less than 0.2 μm in view of the slight roughness of the surface of the metal material in a normal manner. The higher the surface finish of the metal material, the smaller the average thickness of the fourth layer should be to ensure that the resistance between the fifth layer and the third layer is small enough. If this thin layer of organic matter is too thick, it will become an insulating layer that will block the electric conductance between the refractory metal alloy plated layer and the metal substrate.

In the arc-ablation switch contact, the refractory metal alloy plated layer is a metal plated layer having a melting point of higher than 1850° C., the plated layer contains a tungsten element having a weight ratio of 10-100%, a molybdenum element having a weight ratio of 0-95%, such transition metal elements as iron, nickel, cobalt, copper, manganese or any composition of these element having a weight ratio of 0-70%; and the sum of the weight ratio of tungsten and that of molybdenum in the plated layer is no less than 30%. Tungsten is an element that is preferred and must be selected for the preparation of refractory metal alloy plated layer, so that the plated layer obtains excellent arc-ablation resistance. Among the refractory metal elements other than tungsten, molybdenum element having a higher melting point, a less toxic compound, a sufficient supply of the market and a lower price is preferred, and a refractory metal alloy containing tungsten is a tungsten-molybdenum alloy or molybdenum-tungsten alloy. The excellent arc-ablation resistance of tungsten and easy processing performance of molybdenum may be combined together by tungsten-molybdenum alloy to a certain extent. In addition, the plated layer may contain such refractory metal elements as rhenium, osmium, tantalum, molybdenum, niobium, hafnium, vanadium, chromium or zirconium.

The ions of such transition metal elements as iron, nickel, cobalt, copper and manganese are added to the tungsten alloy plating bath in order to adhere the plated layer to the substrate firmly and then to accelerate the rate of chemical deposition. The ions of tin, antimony, lead or bismuth and other elements can also be added into the plating bath, so that the plated layer obtains the specific performance. For example, a small amount of stannous ions is added into the plating bath, or stannous ions, antimony ions and lead ions are added into the plating bath, so that the hardness of the plated layer may be reduced. Due to the use of phosphorus-containing or boron-containing reducing agent, a small amount of phosphorus may also be deposited in the plated layer. However, due to the high content of phosphorus and boron in the plated layer, the initial surface resistance of the plated layer will be increased. Therefore, measures should be taken to control the concentration of reducing agent in the plating bath and the temperature of the plating bath to control the content of phosphorus and boron in the plated layer.

A hydrophilic rubber, a rubber material containing a surfactant or an anti-static agent, a rubber material containing a large amount of hydrophilic or water-absorbent filler and is not suitable to be used in the present invention. If these rubber materials are used, the refractory metal alloy is also deposited on these rubber materials during chemical plating. In general, the stronger the hydrophobicity of the rubber material used is, the more favorable is the deposition of the refractory metal alloy on the metal surface in the rubber-metal layered complex used in the present invention rather than deposition on the surface of the rubber material. Polar rubber like nitrile rubber and hydrogenated nitrile rubber with a high nitrile group content, carboxy-terminated butadiene nitrile liquid rubber, chlorosulfonated polyethylene rubber, epichloro-hydrin rubber, acrylic rubber, urethane rubber, and hydrophilic rubber (like hydrophilic silicone rubber), water swelling rubber and other materials have big polarity or contain a great amount of hydrophobic substances, so that the surface hydrophoby of these materials is weak. These materials are in the chemical plating bath containing a soluble refractory metal compound, and the refractory metal alloy plated layer will be deposited on the surface of these materials.

As an optimization, the hydrophobic rubber layer is composed of a rubber material enabling a water contact angle on a rubber surface to be greater than 65 degrees since contents of carboxyl, hydroxyl radical, carbonyl, amino group, acylamino, nitrile group, nitro, halogeno, sulfhydryl group, sulfonate and benzene sulfonate are low; or, the hydrophobic rubber layer is composed of a rubber material enabling the water contact angle on the rubber surface to be greater than 65 degrees since the rubber contains no or contains a small amount of hydrophilic filler or additive. The rubber material is thermoset or thermoplastic.

As a further optimization: the hydrophobic rubber layer is prepared by ethylene propylene diene monomer, methylvinylsiloxane gum or polymethylvinylphenylsiloxane gum. The ethylene propylene diene monomer, methylvinylsiloxane gum and polymethylvinylphenylsiloxane gum are non-polar rubber, which have strong hydrophoby and good weather resisting property at the same time, and can keep excellent elasticity for a long term in atmosphere; therefore, the ethylene propylene diene monomer, methylvinylsiloxane gum and polymethylvinylphenylsiloxane gum are materials preferably selected for the hydrophobic rubber layer.

The hydrophobic rubber layer is made of hydrophobic rubber. The hydrophobic rubber has water repellency, and water cannot be spread on the surface of the hydrophobic rubber. To implement selective chemical deposition of refractory metal alloy on the metal material, the hydrophoby of the rubber material in the complex of the hydrophobic rubber layer and the sheet metal is the higher, the better. To make the alloy deposited on the hydrophobic rubber layer to an amount that can be ignored when performing chemical deposition by the above-mentioned plating bath, the water contact angle of the rubber substrate needs to be greater than 65 degrees. The term "selective chemical deposition" as used herein refers to a refractory metal alloy plated layer which is selectively deposited on a metal material but not on a rubber material. The carboxyl, hydroxyl radical, carbonyl, amino group, acylamino, nitrile group, nitro, halogeno, sulfhydryl group, sulfonate and benzene sulfonate on the rubber molecular chain will greatly increase the polarity and hydrophily of the rubber. Particularly, the carboxyl, hydroxyl radical, sulfonate and benzene sulfonate will greatly increase the polarity and hydrophily of the rubber. If a carboxylic rubber having hydrophily is used in the complex of rubber and metal, then the chemical deposition will occur on both the surface of metal material and that of the rubber material in the meanwhile. If a refractory metal alloy deposit layer is formed on the rubber material, not only the chemical plating bath is wasted, but also the heat vulcanization adhesion or thermoplastic adhesion of the rubber material with other rubber material is unfavorable, while the heat vulcanization adhesion or thermoplastic adhesion is required in subsequent processing. The first layer of hydrophobic rubber layer is to perform the heat vulcanization adhesion or thermoplastic adhesion to the other rubbers, thereby preparing the rubber keypad containing contact.

Therefore, it is necessary to limit the content of these polar groups in the rubber substrate, so as to obtain the chemical deposit having selectivity. In order to obtain the best selective chemical deposition, the rubber substrate cannot contain these groups. For the same reason, the body or surface of rubber material contains no or contains a small amount of hydrophilic filler, additives, anti-static agent or surfactants, but also is conducive to the selective chemical deposition.

The ethylene propylene diene monomer, methylvinylsiloxane gum and polymethylvinylphenylsiloxane gum are weak polar rubber materials, which have strong hydrophoby, and thus are suitable for compositing with the sheet metal to prepare the layered complex. When the chemical plating bath is used for chemical plating, the chemical deposition does not occur on the rubber layer.

As an optimization: the sheet metal layer is a metal sheet having a convex point or a concave point, a metal sheet having a convex line or a concave line, a metal sheet having a convex surface or a concave surface, a metal sheet having a small hole with an area less than 1 $mm^2$, a metal gauze, metal foams or a metal fiber sintered felt, so as to have higher contact pressure intensity with the contact on the PCB, and better conductivity; the metal material is iron, copper, aluminum, nickel, cobalt, zinc, titanium, tin, silver, molybdenum, or an alloy containing the elements; and the sheet metal layer is a single metal material or composited by different metal materials in a layered manner. The metal or alloy, having higher electrical conductivity and lower price, is preferred.

As an optimization, the sheet metal is composed of a stainless steel sheet, a copper or copper alloy sheet, and a nickel or nickel alloy sheet having a thickness of 0.01-1.0 mm, and a pure nickel layer or a nickel alloy layer having a thickness of 0.1-10 μm is plated on one side or two sides of the stainless steel sheet, the copper or copper alloy sheet and the nickel or nickel alloy sheet; and the nickel alloy layer on the stainless steel sheet, the copper or copper alloy sheet, and the nickel or nickel alloy sheet is prepared by vacuum plating, electroplating or chemical plating. Plating one pure nickel layer or nickel alloy layer on the stainless steel, the copper or copper alloy sheet, and the nickel or nickel alloy sheet may improve the adhesive strength between the sheet metal and the refractory metal alloy plated layer, and avoid the refractory metal alloy plated layer from falling out during the use process of the contact. Especially for copper and copper alloy sheets, it is desirable to be plate a thin layer of pure nickel layer or nickel alloy on both surface of the copper a copper alloy sheets prior to the chemical deposition of refractory metal alloy plated layer to improve the oxidation and chemical resistance of the copper and copper alloy.

The above-mentioned stainless steel is common stainless steel, acid-resistant steel, or special stainless steel added with molybdenum element so as to improve atmospheric corrosion resistance, in particular, corrosion resistance of chloride-containing atmosphere.

The thickness of the sheet metal should not be too thin. If the thickness of the sheet metal is lower than 0.01 mm, the refractory metal alloy plated layer cannot be supported preferably, and the sheet metal is easy to break before, during or after the processing of being composited with the rubber. If the sheet metal is too thick, the entire hardness of the contact will be increased, which makes separating or punching processing to be difficult, and also wastes the metallic materials. Therefore, the thickness of the sheet metal should be no more than 1.0 mm.

To prepare the hydrophobic rubber layer and the sheet metal into a layered complex in advance is to facilitate using the layered complex as a contact to prepare a rubber keypad. Heat vulcanization adhesion or thermoplastic adhesion can be directly conducted between the hydrophobic rubber on the layered complex and other rubber to form a rubber keypad. If the rubber keypad is formed without performing heat vulcanization adhesion or thermoplastic adhesion between the sheet metal of the rubber layer and other rubber, an excessive rubber phenomenon will occur during moulding. The so-called excessive rubber phenomenon means that the rubber overflows to the front side of the contact during moulding, thus affecting the electrical conductivity of the contact. The excessive rubber phenomenon on the contact is unacceptable from the aspect of the quality of the contact.

The second layer and the fourth layer are formed by a coupling agent or metal rubber adhesion agent that promotes rubber to adhere to metal; a chemical composition of the second may be identical to or different from that of the fourth layer; for example, the second layer is prepared by a rubber-metal adhesion agent, while the fourth layer is prepared by a coupling agent, which may be selected from a silane coupling agent having an amino group, an epoxy group, a hydroxyl group, a mercapto group, an isocyanate group, and an preoxide group, so that the coupling agent layer on the metal substrate after the treatment of the sheet metal with the coupling agent has a good adhesive force to the deposited refractory metal alloy. When a hydrophobic rubber having self-adhesive action with the sheet metal is used, the rubber itself has good adhesion to the sheet metal, so that the second layer may not be applied.

In the prepared contacts in a plurality of layers of layered structure, the polarity of the material constituting the adhesive layer (the second layer and fourth layer in the contact) needs to be larger than that of the hydrophobic rubber used, and the water contact angle on the surface of the material needs to be 10 degrees less than the water contact angle on the hydrophobic rubber surface to ensure that the plated layer of the refractory metal alloy is preferentially deposited on the surface of the adhesive layer rather than being deposited on the surface of the hydrophobic rubber.

The coupling agent is a silane coupling agent, a titanate coupling agent, a zirconium coupling agent, or a chromium complex coupling agent. An aminosilane coupling agent, an epoxy silane coupling agent, a mercapto silane coupling agent or a peroxy silane coupling agent is preferred. A surface water contact angle of the coupling agent after filming on the sheet metal is 10 degrees smaller than the water contact angle on the hydrophobic rubber surface; an aminosilane coupling agent, an epoxy silane coupling agent, a mercapto silane coupling agent or a peroxy silane coupling agent is preferred. When the metal substrate treated by these coupling agents is subject to chemical plating, the plated layer of refractory metal alloy is easily deposited thereon, and has a good adhesive force.

The rubber-metal adhesion agent is heat-cured or photo-cured; the heat-cured rubber-metal adhesion agent is preferred in the form of a carboxylic rubber type, a self-adhesive silicone rubber type or a siloxane polymer type. The photo-curable rubber-metal adhesion is of a urethane acrylate type; the surface water contact angle after curing of the rubber-metal adhesion agent is 10 degrees less than the water contact angle on the hydrophobic rubber surface.

The second object of the invention is to provide a preparation method of the arc-ablation resistant tungsten alloy switch contact.

Second technical solution: a preparation method of the arc-ablation resistant tungsten alloy switch contact comprises the following steps of (1) treatment of sheet metal layer: the sheet metal being a stainless steel sheet, a copper or copper alloy sheet and a nickel or nickel alloy sheet having a thickness of 0.01-1.0 mm; mechanically roughing a surface of the sheet metal (such as sand blasting and polishing), or processing the sheet metal through chemical etching (into concave pits or convex points having a diameter less than 1 mm; or plating a pure nickel layer or a nickel alloy layer having a thickness of 0.1-10 μm on one side or two sides of the sheet metal by electroplating or chemical plating; then deoiling and cleaning the sheet metal obtained, wherein an alkaline cleaning solution and an organic solvent being used to deoil and electrochemically deoil.

coating the coupling agent layer or the rubber-metal adhesion agent layer on one surface or two surfaces of the sheet metal by a silk-screen printing, dip coating, shower coating, scrape coating, gasket coating, roller coating, roller-brushing coating or spray coating method; or adhesive layers on two surface of the sheet metal having the same chemical composition, or having the same thickness;

(2) adhesion treatment of hydrophobic rubber layer and sheet metal layer: adhering a hydrophobic rubber layer onto the sheet metal layer plated with a coupling agent or a rubber-metal adhesion agent through heat vulcanization adhesion and heat vulcanization shaping, to form a composite sheet; or adhering the hydrophobic rubber with self-adhesiveness on a sheet metal layer not plated with a runner coupling agent or a rubber-metal adhesion agent through heat vulcanization shaping, to form a composite sheet;

(3) cutting treatment: punching the composite sheet in the step above into a cylinder having a diameter of 2-10 mm; or punching the composite sheet in the step above into an object having a cross section in a shape of ellipse, polygon, crisscross, star or crescent or any combinations thereof; using a basic cleaning liquid to wash the object for about 5 min, washing the object by water, then using 5% hydrochloric acid to clean the object for about 3 min, using deionized water to clean the object cleanly, and then draining off the object;

(4) preparation of refractory metal alloy plated layer: dipping the cylinder or the object above in a chemical plating bath containing a soluble tungsten compound or other soluble refractory metal compounds and stirring to form a refractory metal alloy plated layer on a metal surface of the cylinder or the object using a method of chemical plating; or, putting the cylinder above into a roller for a chemical plating bath containing a soluble tungsten compound and other soluble refractory metal compounds to make the roller rotate and form a refractory metal alloy plated layer on the metal surface of the cylinder or object using a method of chemical plating;

the plating bath containing 10-120 g/L soluble tungsten compound, 0-60 g/L soluble compound of rhenium, osmium, tantalum, molybdenum, niobium, hafnium, vanadium, chromium or zirconium or any combination of these compounds, 0-60 g/L soluble compound of a transition metal like ferrum, nickel, cobalt, copper or manganese or any combination of the compounds, 0-30 g/L soluble compound of tin, stibium, lead or bismuth or any combination of the compounds, 20-140 g/L reducing agent, 30-150 g/L complexing agent, 20-100 g/L pH adjuster, 0.1-1 g/L stabilizer, 0.1-1 g/L surfactant, and 0-50 g/L brightener or roughness adjuster;

sodium tungstate being preferably selected as the soluble tungsten compound;

sodium hypophosphite being preferably selected as a reducing agent in the plating bath, wherein when the sodium hypophosphite being adopted as the reducing agent, a temperature for chemical plating adopted on the refractory metal alloy plated layer being 60-90° C., the time being 30-300 min, and a pH value of the plating bath being 8.0-10.0.

(5) cleaning and drying: taking out the plated object above, using distilled water or deionized water to rinse the object, then draining the object off, and using cold air to blow-dry, or putting the object into a 70° C. constant temperature oven to dry, thus obtaining a switch coated with refractory metal alloy;

When tungstic acid or tungsten trioxide insoluble in pure water is selected as a tungsten source, tungstic acid or tungsten trioxide is firstly dissolved by sodium hydroxide solution, and then the dissolved tungstic acid or tungsten trioxide is dissolved to configure a chemical plating bath. The soluble sodium tungstate having a lower price is preferably selected to prepare the chemical plating bath. The soluble molybdenum compound is sodium molybdate, potassium molybdate, ammonium molybdate, phosphomolybdic acid, ammonium phosphomolybdate, molybdic acid, and molybdenum trioxide. When molybdate slightly soluble in water or water-insoluble molybdenum trioxide is used as a molybdenum source, it can be dissolved with sodium hydroxide solution and then used to formulate a chemical plating bath. Soluble compounds of the other refractory metals include sodium perrhenate, potassium perrhenate, ammonium perrhenate, potassium osmate, tantalum hydroxide or hydrated tantalum pentoxide, potassium fluorotantalate, potassium niobate, hydrated niobium oxide, hafnium oxychloride octahydrate, potassium hexafluoro hafnate, sodium vanadate, sodium metavanadate, sodium orthovanadate, ammonium metavanadate, vanadium pentoxide, potassium dichromate, dichromium trioxide (dissolved with an alkaline solution before use), potassium hexafluorozirconate, zirconyl nitrate and the like.

The soluble nickel compound is one or more of nickel sulfate, nickel chloride, nickel nitrate, nickel ammonium sulfate, basic nickel carbonate, nickel aminosulfonate, nickel acetate, or nickel hypophosphite. When nickel hydroxide is used, it is firstly dissolved with ammonia water. We found that during the course of plating the tungsten-molybdenum alloy, nickel sulfate is composited with basic nickel carbonate in the electroplating plating bath as a precursor of nickel, so that the plated tungsten-molybdenum alloy layer has a relatively bright silver-white, and the surface resistance of the obtained tungsten-molybdenum alloy plated layer is low. The soluble cobalt compound is one or more of cobalt sulfate, cobalt chloride, cobalt nitrate, cobalt ammonium sulfate, basic cobalt carbonate, cobalt aminosulfonate, cobalt acetate, or cobalt oxalate. The soluble compound is one or more of copper sulfate, copper chloride, copper nitrate, copper hydroxide carbonate, or copper acetate.

Compounds of soluble transition metal elements other than nickel, cobalt and copper, and soluble tin compounds, antimony compounds, bismuth compounds and lead compounds may be added into the plating bath, but it is to be noted that these compounds have selective influences on the substrate deposited by chemical plating. In addition, attention should be paid to the physiological toxicity, environmental toxicity and hazardous properties of these compounds. For example, soluble lead compounds that are harmful to the human body and the environment should be minimized or eliminated. Although silver is an element commonly used in electrical contacts or contacts, it is not recommended to add such soluble silver compounds as silver nitrate into the tungsten-molybdenum alloy plating bath. Since we found in the experiment that after a certain amount of silver nitrate (e.g., 5 g/L) was added into the tungsten-molybdenum alloy plating bath, the chemical deposition occurred in chemical plating the layered complex of the first layer of the hydrophobic rubber layer and the second layer of the sheet metal layer occurs in both the second layer of the sheet metal layer and the first layer of hydrophobic rubber layer, so that the substrate is not selected by the chemical deposition. When the deposition time is long enough, it is clearly seen by the naked eye that a layer of grayish black or silvery white is deposited on both the hydrophobic rubber layer and the sheet metal layer. X-ray fluorescence spectroscopy revealed that both the surface of the sheet metal layer and the surface of the hydrophobic rubber layer contained a large amount of silver. After the addition of silver nitrate was canceled by the same formulation, the chemical depositing layer is only generated on the metal surface of the sheet metal layer during chemical plating.

The reducing agent is one or more of sodium hypophosphite, sodium borohydride, alkylamine borane, hydrazine, or titanium trichloride. If boron hydride or aminoborane is used as the reducing agent, the tungsten-molybdenum alloy plated layer will contain a small amount of boron (mass fraction of up to 7%). If hydrazine is used as a reducing agent, the content of non-metal (phosphorus or boron) in the obtained plated layer is almost zero, but the metal content can reach more than 99%. When sodium hypophosphite is used as a reducing agent, phosphorus is jointly deposited with metal due to the precipitation of phosphorus, thus the plated layer still contains a small amount of phosphorus besides metal elements. Phosphorus is detrimental to the electrical conductivity of the contacts, and may damage to the corrosion resistance of the refractory metal alloy. Therefore, it is necessary to control the phosphorus content of the tungsten-molybdenum alloy. By controlling the concentration of sodium hypophosphite, the concentration of complexing agent, pH value and other measures, the phosphorus content in the coating may be controlled. A dense, non-porous tungsten-molybdenum alloy plated layer or other refractory metal alloy plated layer may be obtained by controlling the phosphorus content. Sodium hypophosphite having lower price and lower toxicity is preferred in the present invention. By using sodium hypophosphite as a reducing agent, the contact resistance between the tungsten-molybdenum alloy plated layers obtained was smaller than that between pure nickel having a nickel content of above 99.5% and pure nickel having a nickel content of above 99.5%, and the obtained plated layer may significantly improve the switching arc-ablation resistance of the metal substrate. If sodium hypophosphite is used as a reducing agent, the reducing agent has a very good cost performance. In order to deposit the tin or stannous ions in the plating bath on the plated layer, titanium trichloride ($TiCl_3$) having stronger reducibility is used as reductant, and some suitable complexing agents such as citrate or sodium salt of ethylene diamine tetraacetic acid (EDTA) are added in the meanwhile.

The complexing agent is one or more of sodium citrate, ammonium citrate, sodium tartrate, potassium sodium tartrate, disodium salt of ethylene diamine tetraacetic acid and tetrasodium salt of ethylene diamine tetraacetic acid. The complexing agent plays a role in controlling the concentration of free metal ions supplied for reaction, improving the stability of the plating bath, extending the service life of the plating bath, and improving the quality of the plated layer. The complexing agent affects the deposition rate, phosphorus content and corrosion resistance, etc.

When sodium hypophosphite is adopted as a reducing agent, the pH value of the plating bath is preferred within 8.5-9.5. The decrease in a pH value of the plating bath will be caused by the production of hydrogen ions as by-product in a chemical plating process. A pH adjuster needs to be supplemented in the chemical plating process. The pH adjuster is one or more of sodium hydroxide, potassium hydroxide, sodium carbonate, ammonia water, sodium pyrophosphate, sodium acetate, potassium pyrophosphate or the like; and ammonia water or sodium hydroxide solution is preferably used to regulate the pH value of the plating bath. In this way, a tungsten-molybdenum alloy plated layer with stronger, more stable adhesion and better quality may be obtained. The price of ammonia water or sodium hydroxide solution is also relatively cheap. When sodium hypophosphite is used as a reducing agent, the pH value of the reducing agent cannot be greater than 12. This is because the excessively high pH accelerates the deposition rate, but the adhesive force between the plated layer or the deposited layer and the metal substrate becomes weak, thus making the color of the plated layer or the deposited layer darker, or even black. In order to stabilize a plating rate and ensure the plating quality, the plating bath must have a buffer capacity, so that a pH value of the plating bath is kept in an appropriate range. Therefore, strong-base weak-acid or strong-acid weak-base may be added into the plating bath as a pH value buffering agent.

The timing of chemical plating is related to the performance requirements for arc-ablation resistance or service life of switch products. The longer the time of the chemical plating is, the thicker the refractory metal alloy plated layer is deposited on the metal substrate. The thicker refractory metal alloy plated layer is conducive to the switching arc-ablation resistance of the contacts. But the chemical plating time is not the longer the better. The too long chemical plating time results in low production efficiency. In addition, and alkaline chemical plating bath may damage to the adhesive strength between the first layer of hydrophobic rubber layer and the second layer of sheet metal layer, and even causes a delaminating phenomenon. As an optimization, if the switching time at a 500 mA on-current is required to be 10,000 or more, the time for the refractory metal alloy plated layer using the chemical plating is 200 min.

Without regard to solar and luster, the stabilizer is a mixture of one or more of potassium iodide, potassium iodate, benzotriazole, 4,5-dithiaoctane-1,8-disulfonate, 3-mercapto-1-propanesulfonate, sodium thiosulfate and thiourea. The brightener (or surface roughness adjuster) may be one or more of commercially available commercialized chemical plating brightener. Without regard to solar and luster, the stabilizer is preferably sodium thiosulfate, thiourea or a mixture of the two, so that the refractory metal alloy plated layer has excellent metallic luster in the meanwhile. The stabilizer plays a role in inhibiting the autocatalytic reaction in the chemical plating process to stabilize the plating bath, preventing the intense autocatalytic reaction and preventing the formation of a large amount of phosphorus-containing ferrous metal powder. But the stabilizer is a poisoning agent for chemical plating, that is, decatalytic reaction, which cannot be overused, and needs to control the amount of its use in the plating bath, so as not to affect the efficiency of chemical plating.

The plating bath adopting chemical plating also contains 0.1-1 g/L surfactant; and the surfactant is one or more surfactants of dodecyl benzene sulfonate, lauryl sulfate and sodium n-octyl sulfate; and is preferably sodium dodecyl sulfate or sodium dodecylbenzene sulfonate. Addition of some surfactants can help spill the gas on the plating part surface, and reduces the porosity of the plated layer, so that the coating is dense, thereby increasing the arc-ablation resistance of the plated layer.

the plating bath also contains brightener or roughness adjuster up to 50 g/L; and the brightener or roughness adjuster is one or more of formaldehyde, acetaldehyde, β-naphthol, 2-methyl aniline-aldehyde condensates, benzalacetone, cuminaldehyde, benzophenone, chlorobenzaldehyde, peregal, schiff base, butynediol, propiolic alcohol, 1-diethylaminoprop-2-yne, propynol ethoxylate, saccharin, sodium benzosulfimide, sodium vinylsulfonate, sodium proparagylsulfonate, pyridine-2-hydroxypropanesulfonate inner salt, alkylphenol polyoxyethylene or commercially available commercialized electroplating or chemical plating brightener. A silver bright refractory metal alloy plated layer may be obtained by adding the brightener.

In the present invention, when the complex of the hydrophobic rubber layer and the sheet metal layer is chemically plated by the plating bath, the refractory metal alloy plated layer may be deposited on the metal surface. The X-ray fluorescence spectrometer (XRF) was used to detect the refractory metal element content of the metal surface. It was found a refractory metal element signal detected on the metal surface became stronger with the increase of chemical plating time in the same plating bath. The refractory metal element signal is getting stronger, which means that refractory metal alloy plated layer becomes thicker following the chemical plating time. However, the refractory metal element signal detected on the surface of the hydrophobic rubber is substantially zero even if the chemical plating time is as long as 300 min.

Advantageous effects: in the present invention, a layer of refractory metal alloy is selectively plated on a layered complex containing a hydrophobic rubber layer and a sheet metal by a chemical plating method. There are a variety of plating methods for an adhesive agent having hydrophobic rubber and sheet metal, the advantage of being relatively convenient manufacture may be selected (such as silk-screen printing, roller coating, scrap coating, dip coating or the like). The metal-rubber adhesive agent may apply an excellent adhesive force between the sheet metal and rubber, or even also apply an excellent adhesive force between a refractory metal alloy plated layer and a sheet metal. The prepared refractory metal alloy plated layer may effectively improve the electrical conductivity and arc-ablation resistance of the sheet metal. The contacts plated with a refractory metal alloy layer made of silicone rubber and stainless steel sheets SS304 are contacted with the gold-plated contacts on a printed circuit board (PCB). The contact resistance between the contacts is smaller than that between the similar contact not plated with refractory metal alloy and that on the PCB, so that the contacts plated with refractory metal alloy layer have better conduction performance. After electrifying a 500 mA direct current between the contact prepared by stainless steel sheet or nickel sheet not plated with refractory metal alloy and the PCB gold-plated contact, and continuously switching about 2000 times at a room temperature, due to the existence of arc-ablation during switching, the contact resistance between the contact prepared by these metal materials and the PCB gold-plated contact is significantly increased (from about 1 ohm to 100 ohm or more, or even non-conductive); however, in the same circuit conditions, after electrifying a 500 mA direct current between the similar contact plated with tungsten-molybdenum alloy and the PCB contact, and switching about 2000 times, the contact resistance between the contact and the PCB contact is still below 1 ohm.

The contact plated with refractory metal alloy has low cost. Compared with the switch contacts plated with gold or silver, this contact may bear the larger current, so that it has better arc-ablation resistance. Moreover, the price of the preferred tungsten, molybdenum materials is much lower than that of gold or silver. In this contact plated with a refractory metal alloy plated layer, the cost of the raw material used in the preparation can also be reduced since molybdenum element can be used to replace part of the tungsten element.

By adjusting the composition of the plating bath and the time and temperature of the chemical plating, the obtained contacts containing the refractory metal alloy plated layer may have an appearance such as color and luster similar to gold, silver, white silver, steel, or certain titanium nitride. The product of the invention is suitable for various kinds of low-voltage apparatuses having strict requirements for the service life of switches, and is particularly suitable for making switch contacts which need to connect, bear and disconnect large electric current of greater than 50 mA under the button in the electric equipment such as automobiles, electric tools and game machines, etc.

The contact prepared in the present invention comprises a hydrophobic rubber layer. The refractory metal alloy is not deposited on the surface of the hydrophobic rubber layer. The existence of the hydrophobic rubber layer facilitates heat vulcanization adhesion and heat vulcanization shaping between such contact and the other rubber, thus preparing a rubber keypad product having a contact.

Wherein, in the figure: 1 refers to hydrophobic rubber layer; 2 refers to adhesive layer of rubber and metal; 3 refers to sheet metal layer; 4 refers to adhesive layer of metal and plated layer; and 5 refers to refractory metal alloy plated layer.

DETAILED DESCRIPTION

The present invention will be further described in details hereunder with reference to the specific embodiments.

Embodiment 1

The compositions of the plating bath were as follows: 45 g/L sodium tungstate, 20 g/L sodium molybdate, 18 g/L nickel sulphate, 28 g/L sodium hypophosphite, 20 g/L sodium acetate, 40 g/L sodium citrate, 16 g/L potassium sodium tartrate, 15 g/L sodium thiosulfate, 1 g/L sodium fluoride, 20 g/L ammonium sulfate, 0.2 g/L thiourea, 0.5 g/L sodium dodecyl sulfate, 0.1 g/L potassium iodate, and proper aqueous ammonia.

A temperature for chemical plating adopted on the metal plated layer being 80° C., the time being 200 min, and a pH value of the plating bath being 8.5-9.5.

Figure 1:
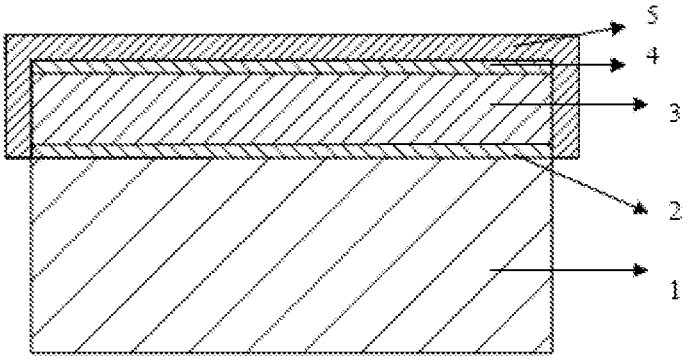
FIG. 1 is a schematic diagram of a sectional structure of the present invention.
Figure 2:
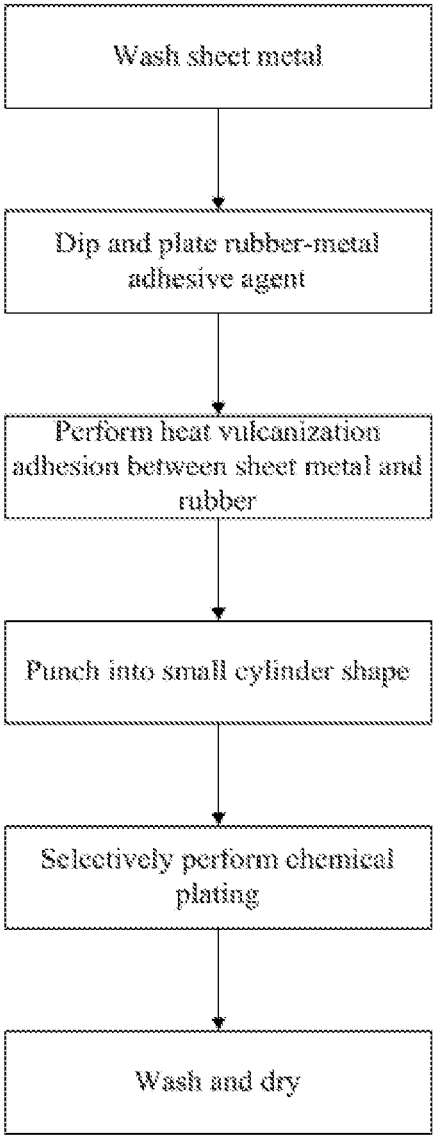
FIG. 2 is a process flow diagram of a preparation method of the present invention.

Process route was as follows:

As shown in FIG. 1 and FIG. 2, the products was composed of a five-layer structure: a hydrophobic rubber layer 1, an adhesive layer 2 of rubber and metal, a sheet metal layer 3, an adhesive layer 4 of metal and plated layer, a refractory metal alloy plated layer 5. The zinc-cupro-nickel sheet had a thickness of 0.1 mm, an HV hardness of 120 to 180, and a copper content of about 55% was used as the metal substrate. The reason for choosing zinc-copper-nickel alloy is that the zinc-copper-nickel alloy has excellent comprehensive mechanical properties, excellent corrosion resistance, and good hot and cold shaping property, and is suitable for manufacturing various elastic elements. The smooth zinc-cupro-nickel sheet was mechanically rolled into a sheet having fine rippers by a mechanical method, which had a crest height of 0.1 mm and a peak pitch of 0.2 mm. A basic cleaning liquid having a pH value around 9 was used to further clean and deoil the sheet under a temperature 60° C., then the sheet was washed by water, washed and deoiled by industrial alcohol, washed by 12.5% sulfuric acid solution under a temperature of 50 to 80° C. for 2 min, and washed by water. Then a nickel layer having a thickness of 2.5-5.0 μm was plated on both sides of the zinc-cupro-nickel sheet having fine ripples by a chemical plating nickel plating bath containing nickel sulfate and sodium hypophosphite in a chemical plating mode. Chemical nickel plating on the metal substrate was a mature process, which would not be elaborated any more herein. The nickel-plated zinc-cupro-nickel sheet having fine ripples was cleaned up by deionized water, and blow-dried by cold air.

Polymethylvinylphenylsiloxane gum (SE 4706U produced by Dow Corning Toray Co.) and dicumyl peroxide (DCP) were uniformly mixed by an open mill. The content of DCP in a rubber compound was 1.0%.

The nickel-plated zinc-cupro-nickel sheet having fine ripples was dipped in a silicon polymer-containing rubber-metal adhesive agent (Megum 14135 prepared by Rohm and Haas Company, U.S.A.) for 1 min, taken out and centrifuged-dry, so that the sheet metal contacts the extremely thin adhesive agent layer.

Heat vulcanization adhesion and heat vulcanization shaping were performed between the stainless steel sheet and the foregoing rubber compound under 165° C., wherein a curing time was 12 min, to form a layered composite sheet containing zinc white copper and silicone rubber and having a thickness of 1.25 mm. The composite sheet was punched into a small rounded grain having a diameter of 5 mm. The small rounded grain was cleaned for various minutes by basic cleaning liquid, washed by water, then dip into 5% hydrochloric acid for 3 min, put into 10% dilute sulfuric acid for activation for 30 s, and then cleaned, and drained off.

500 small wafers above were put into 600 mL plating bath above under a temperature of 80° C. and stirred, taken out after 200 min, rinsed by distilled water or deionized water, drained off, and blow-dried by cold air or put into a 70° C. constant temperature drying oven to dry, thus obtaining small wafers with a metal surface layer plated with tungsten-molybdenum alloy. During the process of chemical plating, attentions should be always paid to the change of the pH value, and the pH value of the solution should be controlled by ammonia water or sodium hydroxide solution in time, so as to make the pH value within 8.5 to 9.5.

Heat vulcanization adhesion and heat vulcanization shaping were performed between the small wafer containing the silicone rubber layer and plated with tungsten-molybdenum alloy and the silicone rubber. Heat vulcanization adhesion was performed between the a silicone rubber face in the small wafer and other silicone rubber, wherein one face plated with tungsten-molybdenum alloy faced outwards, so that the tungsten-molybdenum alloy layer might be contacted with a contact on a printed circuit board (PCB). After heat vulcanization shaping between the small wafer and the silicone rubber, a rubber keypad might be produced. It was this small wafer was used as a contact of a circuit switch in the rubber keypad. The contact was contacted with a gold-plated contact of the PCB, having a stable, lower contact resistance. Moreover, the small wafer plated with tungsten-molybdenum alloy had better conduction performance: after electrifying a 500 mA direct current between the small wafer made of zinc-cupro-nickel not plated with tungsten-molybdenum alloy plated layer or zinc-cupro-nickel plated with nickel and the PCB gold-plated contact, and switching about 3000 times, due to the arc-ablation during switching on or off, the contact resistance between the small wafer and the PCB gold-plated contact was significantly increased (from about 1 ohm to 100 ohm) or more, or even non-conductive condition during multiple tests); however, in the same circuit conditions, after electrifying a 500 mA direct current between the small wafer plated with tungsten-molybdenum alloy and the PCB gold-plated contact, and switching about 10000 times, the contact resistance between the small wafer and the PCB gold finger is still below 1 ohm.

Embodiment 2

A stainless steel sheet having a thickness of 0.05 mm and a model of SS304 was used to replace the zinc-cupro-nickel sheet having fine ripples and plated with nickel in embodiment 1. An ethanol solution containing 2% vinyl tris-tert-butyl peroxy silane (VTPS) is sprayed on both sides of the stainless steel sheet in a spray coating method, and blow-dried for standby. The above-mentioned stainless steel sheet and the rubber compound of the silicone rubber in embodiment 1 was subject to hot embossing and shaping in a mould plated with Teflon in die cavity to form a stainless steel-silicone rubber composite sheet having a thickness of 1.0 mm. The complex sheet was punched into a cylinder having a diameter of 5 mm, and the chemical plating method in embodiment 1 was used to prepare the contact containing the refractory metal plated layer. In the prepared contacts plated with a refractory metal alloy layer, there was a good adhesive strength between the stainless steel and the silicone rubber, and between the plated layer and the stainless steel. Compared with the similar contact not plated with a plated layer, the arc-ablation resistance or service life in the contact was improved by more than one times.

Embodiment 3

The stainless steel sheet in embodiment 2 was compounded with the silicone rubber containing 1% VTPS to form a complex sheet containing stainless steel and silicone rubber and having a thickness of 1.0 mm. An ethanol solution containing 2% N-(2-aminoethyl)-3-aminopropyltriethoxysilane was sprayed on the surface of stainless steel in the complex sheet, and then the complex sheet was baked under a temperature of 70° C. for 30 min. The complex sheet was punched into a cylinder having a diameter of 5 mm, and the chemical plating method in embodiment 1 was used to prepare the contact containing the refractory metal plated layer. With respect to the prepared contact plated with the refractory metal alloy layer, the plated layer was firmly adhered to stainless steel. Compared with the similar contact not plated with a plated layer, the arc-ablation resistance or service life in the contact was improved by more than one times.

Those having ordinary skills in the art may also make many improvements and polish without departing from the principle of the invention, which shall all be deemed as the protection scope of the invention.

What is claimed is:

1. An arc-ablation resistant switch contact, wherein the switch contact is a complex having a plurality of layers of layered structure, comprising:

- a first layer, which is a hydrophobic rubber layer having a thickness of 0.1-10 mm;
- a second layer, which is an adhesive layer having a thickness of 0-1.0 μm, the adhesive layer of the second layer including a coupling agent or a metal rubber adhesion agent;
- a third layer, which is a sheet metal layer having a thickness of 0.01-1.0 mm;
- a fourth layer, which is an adhesive layer having a thickness within a range of a thickness of a monomolecular layer to an average thickness of 0.2 μm, the adhesive layer of the fourth layer including a coupling agent or a metal rubber adhesion agent; and
- a fifth layer, which is a refractory metal plated layer having a thickness of $2*10^{-5}$-0.02 mm and containing tungsten, rhenium, osmium, tantalum, molybdenum, niobium, iridium, hafnium, vanadium, chromium or zirconium alloy, wherein the fifth layer of refractory metal alloy plated layer is deposited on surfaces of the second layer, the third layer and the fourth layer in the complex or is deposited on a surface of the fourth layer in the complex.

2. The arc-ablation resistant switch contact according to claim 1, wherein the fifth layer of refractory metal alloy plated layer is chemically deposited on surfaces of the second layer, the third layer and the fourth layer in the complex or is chemically deposited on a surface of the fourth layer in the complex.

3. The arc-ablation resistant switch contact according to claim 1, wherein the fifth layer and the third layer are electrically communicated, and a resistance therebetween is less than 10 ohms.

4. The arc-ablation resistant switch contact according to claim 1, wherein the first layer is composed of a rubber material enabling a water contact angle on a rubber surface to be greater than 65 degrees.

5. The arc-ablation resistant switch contact according to claim 4, wherein the rubber material is nonpolar or weak polar rubber.

6. The arc-ablation resistant switch contact according to claim 5, wherein the rubber material is ethylene propylene diene monomer, methylvinylsiloxane gum or polymethylvinylphenylsiloxane gum.

7. The arc-ablation resistant switch contact according to claim 1, wherein the sheet metal layer is a metal sheet having a convex point or a concave point, a metal sheet having a convex line or a concave line, a metal sheet having a convex surface or a concave surface, a metal sheet having a small hole with an area less than 1 $mm^2$, a metal gauze, metal foams or a metal fiber sintered felt, wherein the metal is magnesium, aluminum, titanium, chromium, manganese, ferrum, cobalt, nickel, copper, zinc, niobium, molybdenum, silver, tin, gold, or an alloy containing the elements, and the sheet metal is a single metal or composited by different metals in a layered manner.

8. The arc-ablation resistant switch contact according to claim 1, wherein the second layer and the fourth layer include a coupling agent or metal rubber adhesion agent that promotes rubber to adhere to metal, wherein a chemical composition of the second layer is identical to or different from that of the fourth layer.

9. The arc-ablation switch contact according to claim 8, wherein the coupling agent is a silane coupling agent, a titanate coupling agent, a zirconium coupling agent, or a chromium complex coupling agent, a surface water contact angle of the coupling agent after filming on the sheet metal is 10 degrees smaller than the water contact angle on the hydrophobic rubber surface.

10. The arc-ablation switch contact according to claim 9, wherein the coupling agent is an aminosilane coupling agent, an epoxy silane coupling agent, a mercapto silane coupling agent or a peroxy silane coupling agent.

11. The arc-ablation switch contact according to claim 8, wherein the metal rubber adhesion agent is heat-cured or photo-cured.

12. The arc-ablation switch contact according to claim 11, wherein the heat-cured rubber-metal adhesion agent is a carboxylic rubber type, a self-adhesive silicone rubber type or a siloxane polymer type.

13. The arc-ablation switch contact according to claim 11, wherein the photo-curable rubber-metal adhesion is of a urethane acrylate type.

14. The arc-ablation switch contact according to claim 11, wherein the surface water contact angle after curing of the rubber-metal adhesion agent is 10 degrees less than the water contact angle on the hydrophobic rubber surface.

15. The arc-ablation switch contact according to claim 1, wherein the refractory metal alloy plated layer is a metal plated layer having a melting point of higher than 1850° C., the plated layer contains a tungsten element having a weight ratio of 10-100%, a molybdenum element having a weight ratio of 0-95%, transition metal elements including iron, nickel, cobalt, copper, manganese or any combination of these element having a weight ratio of 0-70%; and the sum of the weight ratio of tungsten and that of molybdenum in the plated layer is no less than 30%.

* * * * *